US009635992B2

(12) United States Patent
Redd

(10) Patent No.: US 9,635,992 B2
(45) Date of Patent: May 2, 2017

(54) SCRUB GLOVES

(71) Applicant: Timothy Redd, Columbia, SC (US)

(72) Inventor: Timothy Redd, Columbia, SC (US)

( * ) Notice: Subject to any disclaimer, the term of this patent is extended or adjusted under 35 U.S.C. 154(b) by 0 days.

(21) Appl. No.: 14/729,706

(22) Filed: Jun. 3, 2015

(65) Prior Publication Data

US 2016/0113472 A1 Apr. 28, 2016

Related U.S. Application Data

(60) Provisional application No. 62/067,494, filed on Oct. 23, 2014.

(51) Int. Cl.
*A47L 13/18* (2006.01)
*A47L 13/12* (2006.01)

(52) U.S. Cl.
CPC ..... *A47L 13/18* (2013.01); *A47L 13/12* (2013.01)

(58) Field of Classification Search
CPC ..... A47L 13/18
USPC ..... 15/227
See application file for complete search history.

(56) References Cited

U.S. PATENT DOCUMENTS

| | | | | |
|---|---|---|---|---|
| 4,621,388 | A | 11/1986 | Ortolivo | |
| 5,956,770 | A * | 9/1999 | Dennis | A47L 13/18 15/227 |
| 6,016,571 | A * | 1/2000 | Guzman | A41D 19/0055 15/227 |
| 6,018,837 | A | 2/2000 | Andreu | |
| 7,210,171 | B2 | 5/2007 | Jacobs et al. | |
| 7,823,245 | B2 | 11/2010 | Firouzman | |
| 8,356,378 | B1 | 1/2013 | Crooms | |
| 2007/0277288 | A1 * | 12/2007 | Sing | A46B 5/04 2/159 |

* cited by examiner

*Primary Examiner* — Laura C Guidotti
(74) *Attorney, Agent, or Firm* — Global Intellectual Property Agency, LLC; Daniel Boudwin

(57) ABSTRACT

A waterproof cleaning glove is provided. The waterproof cleaning glove includes a body having a palm portion and five finger stalls projecting therefrom. The palm portion and the five finger stalls are made of a water-proof polymer material. The five finger stalls each having a tip portion and base portion at a junction of the finger stall with the palm portion. A scouring pad is affixed to the palm portion and the base portion of the each finger stall by a water-proof adhesive. The scouring pads extend from the base portion of each of the finger stalls to a knuckle region. Sponges are located on the tip portion of each of the finger stalls. The sponges extend up the front side of the finger stall and over the tip portion.

5 Claims, 2 Drawing Sheets

SCRUB GLOVES

CROSS REFERENCE TO RELATED APPLICATION

This application claims the benefit of U.S. Provisional Application No. 62/067,494 filed on Oct. 23, 2014. The above identified patent application is herein incorporated by reference in its entirety to provide continuity of disclosure.

FIELD OF THE INVENTION

The invention generally relates to a cleaning glove. More specifically, the present invention relates to a waterproof cleaning glove having a palm portion and five finger stalls projecting therefrom. The palm portion includes a scouring pad disposed thereon. The finger stalls include a scouring pad on a base portion othereof and an absorbent sponge on the fingertip portion of the finger stall.

BACKGROUND OF THE INVENTION

Household surfaces, such as tables and countertops, are often cleaned using scouring pads and sponges that help loosen and remove grime and stains. Particularly, scouring pads are used to remove tough stains and build-up, and a sponge is used thereafter to clean up and soak the broken up stains and liquids on the surface. The scouring pad and sponge are typically used in combination, requiring a user to constantly switch between both the scouring pad and sponge. Using and retrieving multiple scouring pads and sponges can be inconvenient and time consuming.

Typically, harsh detergents and other chemicals are used when cleaning surfaces with tough, built-up stains. Waterproofed gloves and mittens have been used to protect a user's hands from harsh detergents and other chemicals necessary in most cleaning operations that require the scouring pad and sponge. It is helpful in numerous applications to use water-tight gloves of rubber, plastic or other polymers. These are commonly seen in kitchen and bathroom use, however, the actual applications extend considerably beyond ordinary household usage. In particular, commercial and industrial applications are far too numerous to list but include any type of situation in which toxic, hazardous, abrasive, or corrosive materials must be handled. In addition, numerous industries require use of such items for protection of workers from unsanitary substances, toxic or hazardous materials and so on during the construction of a wide variety of different materials, supplies and end products.

In some instances, abrasive cleaning surfaces have been attached to certain gloves or mittens, including gloves or mittens which are waterproof. These abrasives, or cleaning surfaces, have been attached to the gloves adjacent to or at the palm area and fingertip of the particular glove. The prior art in this respect is exemplified by U.S. Pat. No. 2,459,521 to Woodbury; U.S. Pat. No. 3,643,386 to Grizyll; and U.S. Pat. No. 4,038,787 to Bianchi; as well as French Pat. No. 2,278,277 to Scott.

The above and other art relates only to the attachment of the abrasive or cleaning material to the palm area and fingertip. The problem encountered therein is the palm of the user is soft and, therefore, is not as effective for the cleaning of difficult surfaces as is a scouring stone or other material having a rigid abrading surface. Further, in that the area of the palm is relatively large, the pounds per square inch that may be applied therefrom, to the working surface, is relatively small.

A shortcoming in prior art cleaning gloves has been the lack of physical flexibility, their incapacity to act as a sponge in order to accomplish the absorption and retention of detergents in solution, and the single cleaning purpose thereof, i.e., particularity of the cleaning surface for which a given cleaning abrasive glove may be used. Thus, there is a need for a cleaning glove that has both a scouring surface and an absorbent sponge.

SUMMARY OF THE INVENTION

In view of the foregoing disadvantages inherent in the known types of cleaning gloves now present in the prior art, the present invention provides a new and improved cleaning glove wherein the same can be utilized for providing convenience for the user when removing tough, built-up stains and grime.

It is therefore an object of the present invention to provide a new and improved waterproof cleaning glove that has all of the advantages of the prior art and none of the disadvantages.

It is a first object of the present invention to provide a waterproof cleaning glove including a body having a palm portion and five finger stalls projecting therefrom. The palm portion and the five finger stalls are made of a water-proof polymer material. The five finger stalls each have a tip portion and base portion at a junction of the finger stall with the palm portion.

It is another object of the present invention to provide a waterproof cleaning glove including a scouring pad located on the palm portion and the base portion of the finger stalls. The scouring pad is affixed to the palm portion and the base portion of the finger stalls by a water-proof adhesive.

It is yet another object of the present invention to provide a waterproof cleaning glove including a sponge located on the tip portion of each of the finger stalls. The sponges extend up the front side of the finger stall and over the tip portion.

Another object of the present invention is to provide a waterproof cleaning glove wherein the scouring pads and sponges are removaby affixed to the body. The scouring pads and sponges may be replaced when they become dull and worn down.

Yet another object of the present invention is to provide a waterproof cleaning glove waterproof cleaning glove wherein the back side of the palm portion and the finger stalls comprise scouring pads thereon. The back side of the palm portion and the finger stalls may additionally include sponges thereon.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
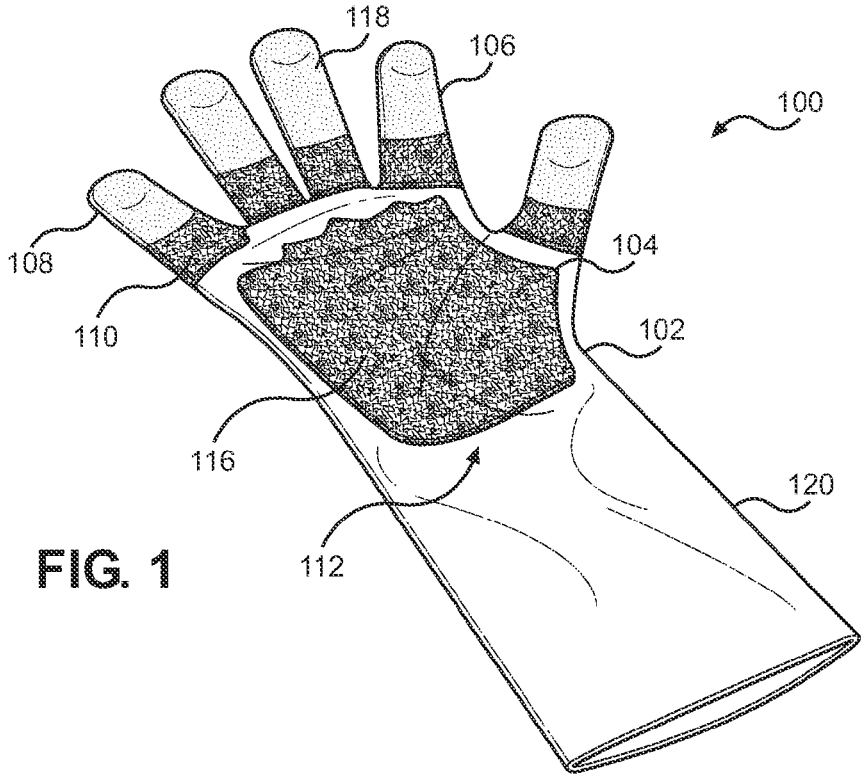
FIG. 1 shows a front side view of the waterproof cleaning glove according to one embodiment of the present invention.

Reference is made herein to the attached drawings. Like reference numerals are used throughout the drawings to depict like or similar elements of the waterproof cleaning glove. For the purposes of presenting a brief and clear description of the present invention, the preferred embodiment will be discussed as used for removing stains. The figures are intended for representative purposes only and should not be considered to be limiting in any respect.

Figure 2:
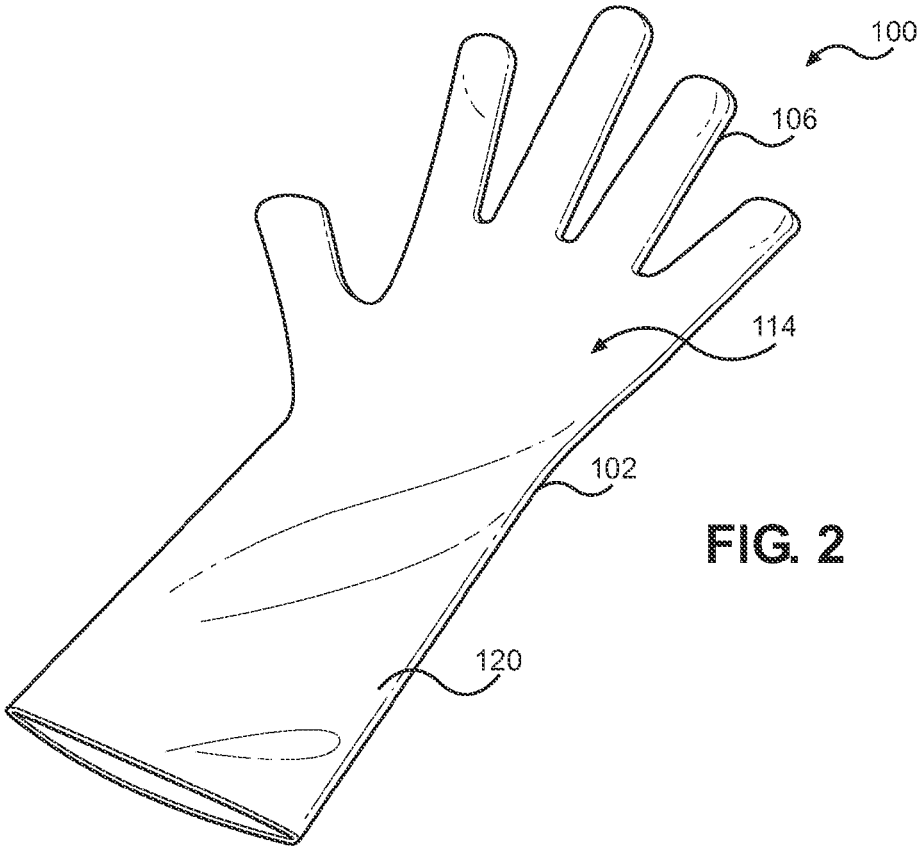
FIG. 2 shows a back side view of the waterproof cleaning glove according to one embodiment of the present invention.

Referring now to FIGS. 1 and 2, there is shown a front side view and back side view of the waterproof cleaning glove, respectively, according to one embodiment of the present invention. The waterproof cleaning glove 100 includes a body 102 having a palm portion 104 and a plurality of finger stalls 106 projecting therefrom. The body 102 is configured to receive a hand therein. The body 102 includes an elongated neck portion 120 that extends over a user's wrist and partially covers a user's arm. The elongated neck portion 120 fits snugly against a user's arm to prevent fluids or other materials from entering the waterproof cleaning glove 100. The body 102 comprises a water-proof polymer material such as polyurethane. It is contemplated that the waterproof glove 100 may comprise a multi-layer fabric, wherein an interior layer is a nylon/insulated acrylic layer and outer shell is a waterproof material.

The finger stalls 106 each have a tip portion 108 and base portion 110. The base portion 110 begins at a junction of the finger stall 106 with the palm portion 104 and extends to the knuckle region. The tip portion 108 begins at the knuckle region and extends over the fingertip. The palm portion 104 and finger stalls 106 having a front side 112 and a back side 114. The front side 112 and the back side 114 may comprise a plurality of scouring pads and sponges. The palm portion 104 and the finger stalls 106 receive the palm and fingers, respectively, of the wearer's hand.

A scouring pad 116 is located on the palm portion 104 and the base portion 110 of the finger stalls 106. The scouring pad 116 is affixed to the palm portion 104 and the base portion 110 of the finger stalls 106 by a water-proof adhesive. The scouring pad 116 substantially covers the palm portion 104. The scouring pad 116 is an abrasive surface used for scouring, cleaning and/or buffing purposes. The scouring pad 116 can be located on the front side 112 and/or back side 114 of the waterproof cleaning glove 100.

A sponge 118 is disposed on the tip portion 108 of each of the finger stalls 106. The absorbent sponge 118 absorbs and retains detergents and fluids in solution, particularly after cleaning the surface using an abrasive that loosens the dirt and grime. The sponges 118 extend up the front side 112 of the finger stall 106 and over the tip portion 108. In a preferred embodiment, the sponge is removably attached to the body 102 of the waterproof cleaning glove 100. When the sponge 118 is worn down or dirty, it may be replaced with new sponge. In this configuration, the sponges 118 and the scouring pad 116 are removably affixed to the glove via a fastener rather than an adhesive.

In one embodiment of the present invention, the back side 114 of the waterproof cleaning glove 100 may include a scouring pad and/or a sponge. The back portion overlays the back of the user's hand. Due to the decreased flexibility of the back of a user's hand, the back side includes a sponge to absorb loosened dirt and grime.

Figure 3:
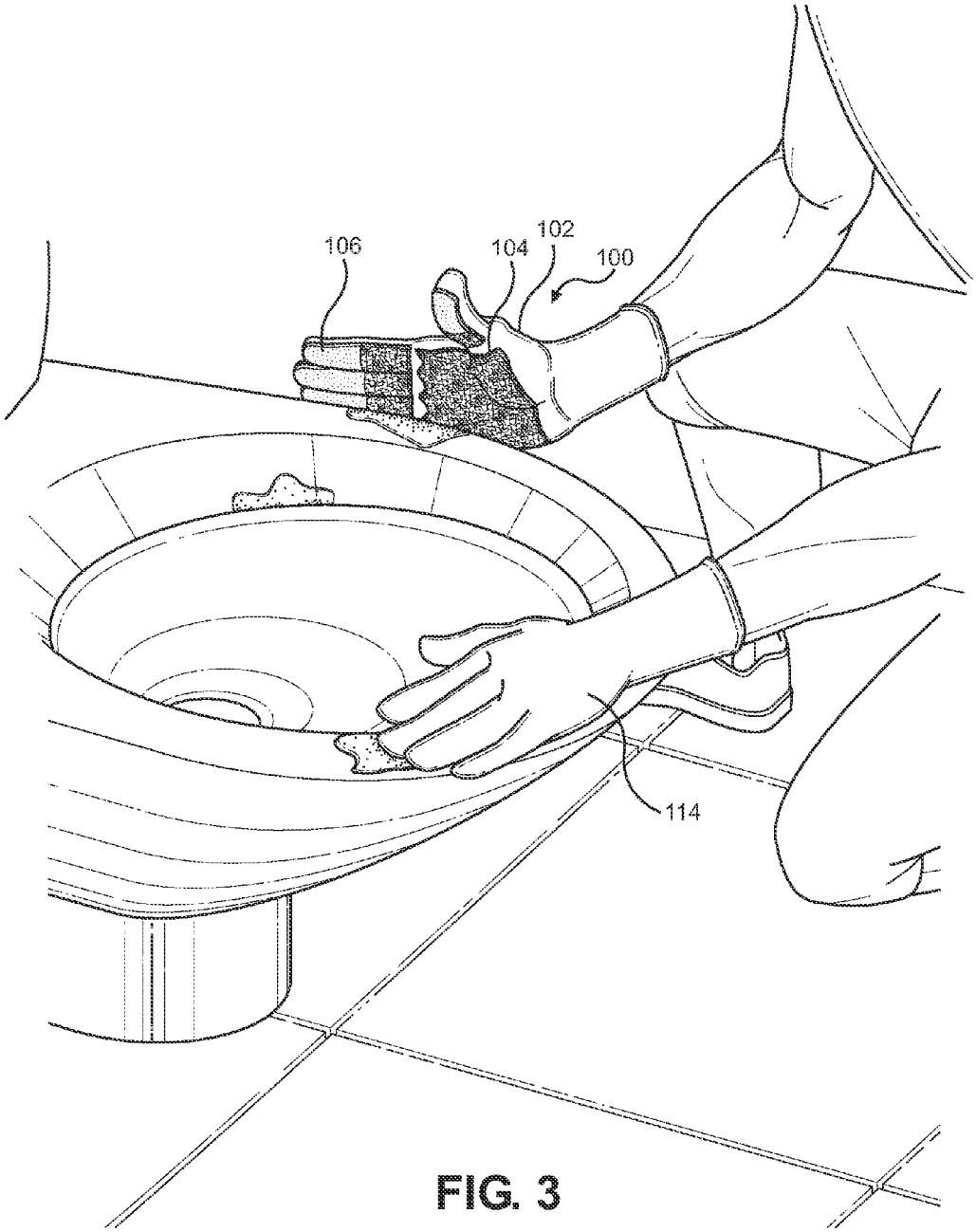
FIG. 3 shows a waterproof cleaning glove fitted over a hand of a user according to one embodiment of the present invention.

Referring now to FIG. 3, there is shown a waterproof cleaning glove fitted over a hand of a user according to one embodiment of the present invention. The waterproof cleaning gloving 100 is provided in a plurality of sizes to accommodate users with different hand shapes. In a preferred embodiment, the scouring pad is located on the palm portion 104 of the body 102. A user is able to apply more pressure per square inch to a cleaning surface by using the palm portion 104. This allows a user to more easily remove tough stains and build-up.

The sponges are preferably located on the tip portion 108 of the finger stalls 106 of the waterproof cleaning glove 100. After an abrasive is applied to the cleaning surface and the dirt and grime are mixed in a fluid solution, the sponge is applied to absorb the solution. The user can clean a surface by moving the waterproof cleaning glove 100 across a surface. The waterproof cleaning glove 100 allows a user to have greater control while cleaning a surface, while protecting the user's hands from contracting germs and chemicals from chemical cleaning supplies. In a preferred embodiment, the waterproof cleaning glove 100 extends to the forearm of a user.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A waterproof cleaning glove, comprising:

a body having a palm portion and five finger stalls projecting therefrom, the palm portion and the five finger stalls constructed from a water-proof polymer material;

each of the five finger stalls each including a tip portion and a base portion;

the base portion extending from a junction of each finger stall with the palm portion to a knuckle region of each finger stall;

the tip portion extending from the knuckle region and extending to an end of each finger stall;

a scouring pad assembly including:

a palm scouring pad coextensive with the palm portion of the body;

a plurality of finger scouring pads, each of the plurality of finger scouring pads coextensive with one of the base portions of each finger stall;

the scouring pad affixed to the palm portion and the base portion of the finger stalls by a water-proof adhesive;

a sponge coextensive with the tip portion of each of the finger stalls, wherein the sponges extend up the front side of the finger stall and over the tip portion.

2. The waterproof cleaning glove of claim 1, wherein the back side of the palm portion and the finger stalls comprise one or more scouring pads thereon.

3. The waterproof cleaning glove of claim 1, wherein the back side of the palm portion and the finger stalls comprise one or more sponges thereon.

4. The waterproof cleaning glove of claim 1, further comprising an elongated neck portion extending from the palm portion adapted to cover the forearm of a user.

5. The waterproof cleaning glove of claim 1, wherein the scouring pad and sponges are removaby affixed to the body via a fastener.

* * * * *